United States Patent [19]

Taylor, Jr. et al.

[11] 4,130,977

[45] Dec. 26, 1978

[54] CONCRETE INSERT

[75] Inventors: William E. Taylor, Jr., Ridgewood; Artin P. Moughalian, Highland Park, both of N.J.

[73] Assignee: Versabar Corporation, Paterson, N.J.

[21] Appl. No.: 757,787

[22] Filed: Jan. 10, 1977

[51] Int. Cl.[2] ..... E04B 1/38

[52] U.S. Cl. ..... 52/710; 52/711; 52/720; 52/738

[58] Field of Search ..... 52/710, 704, 701, 699, 52/624, 730, 731, 716, 312, 711, 378, 379, 720, 738; 249/83, 91, 35

[56] References Cited

U.S. PATENT DOCUMENTS

| | | | |
|---|---|---|---|
| 827,613 | 7/1906 | Brown | 52/710 X |
| 1,155,243 | 9/1915 | Jordahl | 52/710 |
| 1,409,524 | 3/1922 | Chase | 52/711 |
| 1,546,901 | 7/1925 | Jordahl | 52/710 X |
| 1,561,126 | 11/1925 | Timm | 52/710 X |
| 1,581,262 | 4/1926 | Zabriskie | 52/710 X |
| 1,988,124 | 1/1935 | Johnson | 52/711 X |
| 2,087,941 | 7/1937 | Weaver | 52/710 |
| 2,181,740 | 11/1939 | Reiland | 52/710 |
| 2,345,650 | 4/1944 | Attwood | 52/710 X |
| 2,380,379 | 7/1945 | Attwood | 52/710 X |
| 3,005,292 | 10/1961 | Reiland | 52/710 X |
| 3,599,386 | 8/1971 | Lalonde | 52/710 |

FOREIGN PATENT DOCUMENTS

| | | | |
|---|---|---|---|
| 59793 | 2/1912 | Switzerland | 52/711 |

*Primary Examiner*—Alfred C. Perham
*Attorney, Agent, or Firm*—Kane, Dalsimer, Kane, Sullivan and Kurucz

[57] ABSTRACT

An improved slotted channel device for anchoring of bolted metal framing systems to concrete walls, ceilings or forms, which device is shaped to provide a front half section having parallel sides with inturned lips adapted to receive a rectangular locking nut which engages the parallel sides and is restricted from turning and a rear half section having sides which flare outwardly in the form of a wedge and serve as an anchor when the device is embedded in concrete.

3 Claims, 5 Drawing Figures

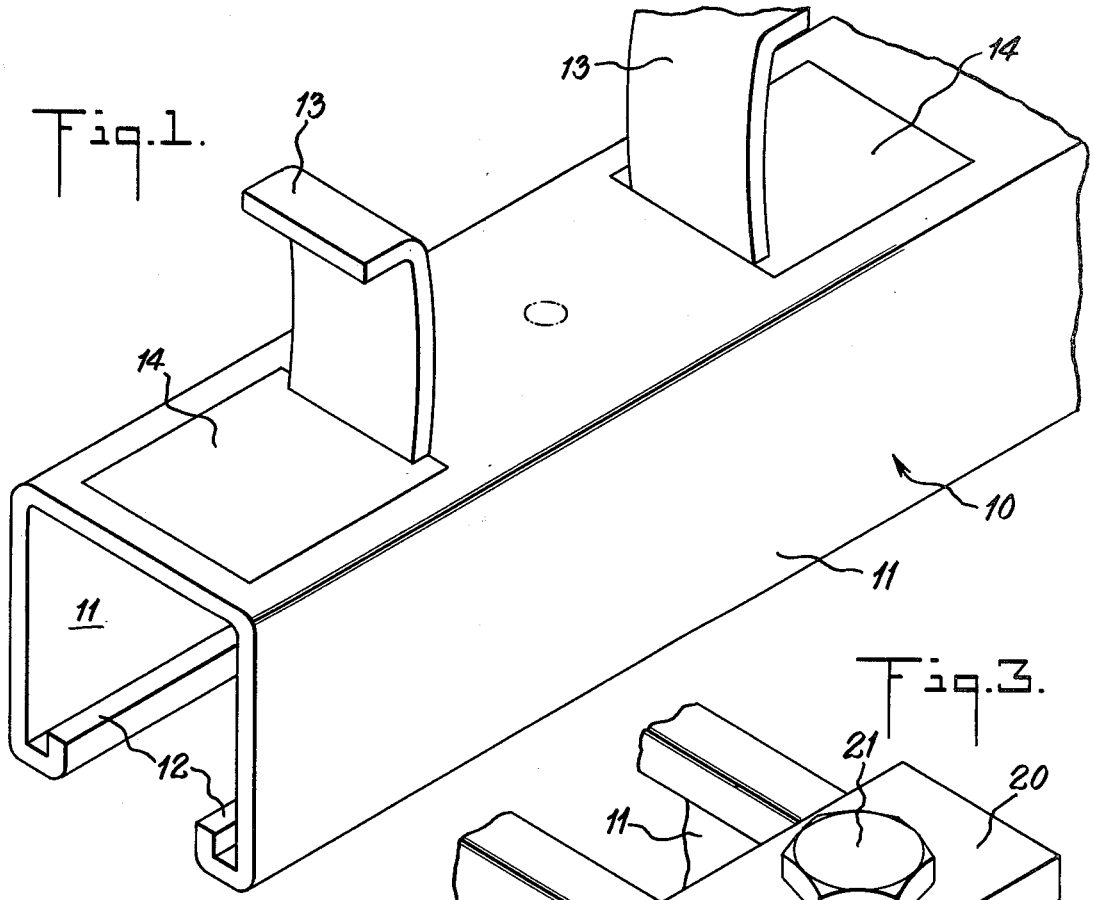
Fig.1.
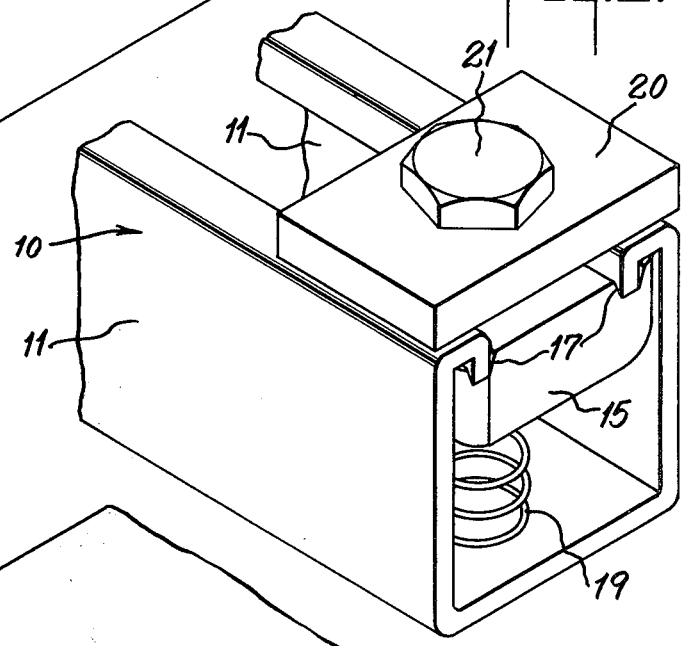
Fig.3.
Fig.2A
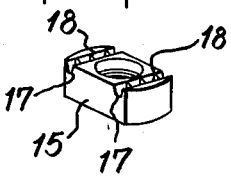
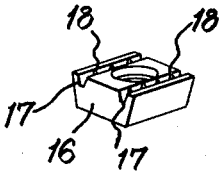
Fig.2B
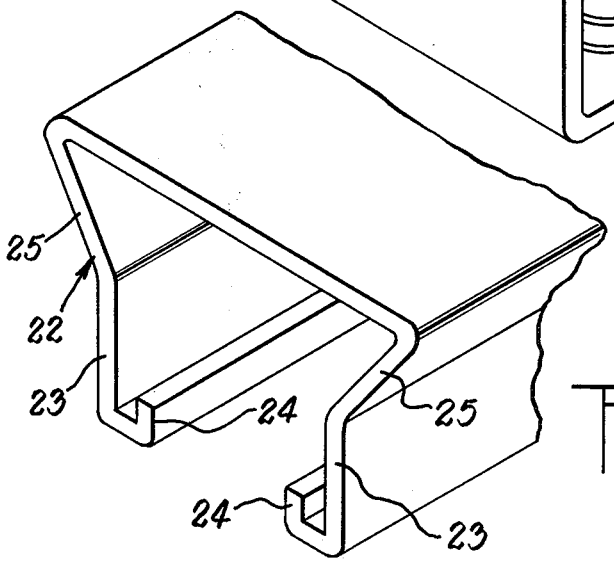
Fig.4.

CONCRETE INSERT

BACKGROUND OF THE INVENTION

This invention relates generally to a slotted insert which can be embedded in concrete to provide a framing system to which brackets and fittings can be fastened at any point. With such framing system components, racks, supports for pipes, wiring and electrical equipment, machine frames and a limitless variety of structures can be affixed to walls, ceilings or other forms. More particularly it relates to an improved slotted channel device compatible with other components of a "strut" type bolted framing system, known generically as "strut systems". Such strut systems have been in large use for many years.

The conventional concrete insert in use in the strut system is a channel with two parallel sides extending to the bottom of the channel with inturned lips at the front edge. Such sides are parallel so that fittings may be fastened to the front slot by means of a rectangular nut with beveled ends which, when inserted into the channel slot, is restricted from turning beyond 90° by the interior channel walls. This restriction positions the nut properly so that, when tightened, its surface serrations and teeth within the serrations engage the inturned lips of the channel. The disadvantage of such inserts with parallel sides throughout is that they must either be pierced from the rear to form anchors (hooks) or have anchors (hooks) welded to the rear or sides to provide a holding means within the concrete. The hooks have sharp edges which are hazardous to workmen. In some cases the hooks interfere with reinforcing bars and other buried reinforcements or conduits in the concrete. In such cases the installers have no alternative but to bend the hooks to avoid the obstruction, which action reduces the loading capability of the hook type insert at that point and creates a hidden hazard when loads are connected at these hidden points so that the manufacturer's published load figures cannot be relied upon. Furthermore, the sharp metal edges on the hook type inserts can affect the integrity of the concrete in which they are embedded since these edges act as "stressrisers" and lower the capacity of the surrounding concrete. This is especially critical in concrete having lower compressive strength.

The concrete insert of the present invention, having a front section of parallel sides to receive the same rectangular nut and rear wedge shape section to serve as an anchor in the concrete, completely eliminates the anchor hooks. All surfaces are smooth and free from sharp edges which provide a safety feature for the installers. It has also been found that this concrete insert offers greater load bearing capacity when installed than other inserts compatible with bolted framing systems. In addition such insert can be installed in concrete without interfering with other buried reinforcements or conduits in the concrete. Since there are no hooks projecting from the insert it is particularly suitable for installation in concrete pours of shallow depth or where interference may be caused by buried reinforcements or buried conduits.

U.S. Pat. Nos. 1,878,921, 1,988,124 and 2,780,936 disclose anchors for concrete which have wedge shapes, but do not provide the parallel side walls at the front portion to make them compatible with the bolted strut system heretofore described.

SUMMARY OF THE INVENTION

It is an object of the invention to provide a slotted channel insert which is so shaped that it is compatible with the bolted strut system and can be securely anchored in concrete.

It is a further object to provide a concrete insert which has a front half section with parallel sides adapted to receive a rectangular locking nut and a rear half section with sides which flare outwardly in the form of a wedge and serve as an anchor when the insert is embedded in concrete.

It is a further object to provide a concrete insert with surfaces that are smooth and free from sharp edges.

It is a further object to provide a concrete insert compatible with a bolted strut system which is safer for installers, can be installed without interfering with buried reinforcements or conduits, and offers a greater load bearing capacity when installed than other inserts.

It is a further object to provide a concrete insert which might function as an alternate component of strut type framing systems wherein the insert might be utilized as a beam or column in rack structures or as a surface metal raceway or underfloor raceway duct when combined with a snap-in closure strip which is a standard device utilized by all manufacturers of strut systems to enclose the front slot and create thereby a raceway or wireway.

It is a further object to provide a concrete insert which is simple and economical to manufacture and install and which is efficient and well suited for its intended purpose.

BRIEF DESCRIPTION OF THE DRAWINGS

Other objects and advantages will become apparent from the following description which is to be taken in conjunction with the accompanying drawings in which:

FIG. 1 is a perspective view of the conventional concrete insert now in use in bolted strut systems showing the parallel sides throughout, the inturned lips of the channel and the hooks required to anchor the insert in concrete;

FIGS. 2 A and B show perspective views of two locking nuts which can be affixed to the insert of FIG. 1 and the insert of the present invention;

FIG. 3 is a perspective view showing the locking nut of FIG. 2A affixed to the insert of FIG. 1; and FIG. 4 is a perspective view of the insert of the present invention showing the front section with parallel sides and the inturned lips adapted to receive the locking nuts of FIGS. 2 A and B and the rear section with the sides flared outwardly for anchoring the insert in concrete.

DESCRIPTION OF THE PREFERRED EMBODIMENT

Referring to the drawings, there is shown in FIG. 1 the conventional concrete insert 10 described above having the parallel sides 11 from top to bottom with the inturned lips 12 and the anchor hooks 13 pierced from or welded to the base of the channel. As shown, the openings created in such base by piercing out the hooks are covered by filler plates 14 to prevent concrete from flowing into the insert.

The locking nuts 15 and 16, shown in FIGS. 2 A and 2 B are either oval (FIG. 2A) or beveled (FIG. 2B) so that when inserted into the channel slot they will be restricted from turning beyond 90° by the interior parallel channel walls. This restriction positions the nut properly so that when tightened, its surface serrations 17 and the teeth 18 within the serrations engage the inturned lips 12 of the channel. The locking nuts may be provided with springs when desirable for the particular positioning of the insert. FIG. 3 illustrates a locking nut 15 provided with a spring 19 secured within the channel. In this instance there is a bar 20 secured to the locking nut 15 by means of a bolt 21 threaded into the locking nut. In similar manner a large variety of fittings, brackets and other components can be fastened to the insert.

The insert 22 of the present invention is illustrated in FIG. 4. Such insert is so constructed and shaped that it can be substituted for the conventional insert above described. It will receive the locking nuts in the same manner so that it is compatible with the strut system described above. However, it eliminates the objectionable hooks of the conventional insert with the result that all surfaces are smooth and free from sharp edges. The insert 22 has a front section with parallel sides 23 and inturned lips 24 to receive locking nuts of the type shown in FIGS. 2A and 2B and a rear section having sides 25 which flare outwardly in the form of a wedge. Such flared wedge section provides an anchor when the insert is embedded in concrete.

This insert has been designed so that all angles and surfaces of the insert are optimized to permit an easy flow of concrete around the exterior surface. This prevents formation of air pockets and voids that tend to weaken the structure. This invention achieves considerably greater load bearing capacity over the hook type insert for two basic reasons. First, the sharp metal edges on hook type inserts can affect the integrity of the concrete in which they are embedded. Secondly, the design of this invention offers greater uniformity of load stress distribution along the inserts' entire length rather than at the centers where hooks are located which are stress points. Thus, the invention allows greater uniformity of loading on all mating surfaces of the concrete. Furthermore, the design relieves as far as possible those conditions which cause crumbling of the visible edges of the concrete.

When inserts of the present invention are embedded in concrete and various components are mounted on such inserts the insert concrete assembly is subjected to both sheer and compression. It has been found that the load bearing capability is superior when the rear sides of the insert are flared outwardly approximately 45° from the parallel sides of the insert. The insert is operative at angles on either side of 45°, but the load bearing capability is decreased as the angle approaches 0° (the sides virtually parallel with little or no flare) or 90° (the rear sides virtually at right angles to the parallel sides so the insert approximates a T).

Independent laboratory tests have been carried out to compare the load bearing capabilities of the insert 22 of the present invention and the hook type insert 10 which has represented the design standard of the bolted framing industry for over 20 years. The test reports clearly establish that the load bearing capability of the invention insert is substantially greater than that of the said hook type insert with parallel sides throughout.

Although they form no part of the present invention, the insert may be protected by several methods to prevent concrete seepage into the interior during the pouring process, either by taping, filling with foam strips or by a combination of hammer in end caps, or plastic caps conforming to the section, and use of foam strips along the slot. Furthermore, the insert will be provided with holes through the web for fastening to the form.

Thus, among others, the several aforenoted objects and advantages are most effectively attained. Although a somewhat preferred embodiment of the invention has been disclosed and described in detail herein, it should be understood that this invention is in no sense limited thereby and its scope is to be determined by that of the appended claims.

Having thus described the invention, what is claimed is:

1. A concrete insert, free from hooks, for anchoring and supporting anchor nuts for retaining various brackets and fittings such as used in a metal framing system with the insert embedded in concrete for its full depth and for either part or all of its entire length, said insert comprising:

an elongated metal channel member of uniform thickness having a flat back wall and side edges, the back wall extending for substantially the entire length of the insert, the uniform thickness of the channel member providing uniformity of load stress along the entire length of said channel member;

a pair of side walls integrally connected to the side edges of the back wall and projecting forwardly an equal distance to the front face of the channel member and terminating in flanges projecting towards each other formed parallel to and spaced from the back wall, said flanges being formed with lips projecting inwardly towards said back wall for supporting a loaded anchor nut without exerting a spreading stress on the channel side walls; and said channel side walls being formed with two longitudinally extending half sections with the outer half sections being parallel to each other so that when the channel member is embedded in concrete with loaded anchor nuts supported therein no wedging stress is exerted on the concrete adjacent the open face of the channel, and with the inner half sections of the side walls flaring outwardly in the form of a wedge so as to anchor the channel member when embedded in concrete and so that any stress exerted on the concrete will be spaced inwardly from the front face of the channel member when the channel member is thus embedded with loaded anchor nuts supported therein.

2. The insert of claim 1 in which the said rear sides are flared outwardly approximately 45° from the said parallel sides.

3. The insert of claim 1 in which the front half section extends approximately one half of the distance from the front to the rear of the insert.

* * * * *